US008155544B2

(12) United States Patent
Nakane

(10) Patent No.: US 8,155,544 B2
(45) Date of Patent: Apr. 10, 2012

(54) IMAGE FORMING APPARATUS AND IMAGE ADJUSTING METHOD INVOLVING A FLUCTUATION-INFORMATION ACQUIRING UNIT AND A CONTROL UNIT THAT FORMS A GRADATION PATTERN

(75) Inventor: Naomi Nakane, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/841,508

(22) Filed: Jul. 22, 2010

(65) Prior Publication Data

US 2010/0290798 A1 Nov. 18, 2010

Related U.S. Application Data

(63) Continuation of application No. 11/618,058, filed on Dec. 29, 2006, now Pat. No. 7,787,786.

(51) Int. Cl.
*G03G 15/20* (2006.01)

(52) U.S. Cl. ..... 399/49; 399/39

(58) Field of Classification Search ..... 399/49
See application file for complete search history.

(56) References Cited

U.S. PATENT DOCUMENTS 5,761,573 A 6/1998 Haneda et al.
7,187,879 B2 3/2007 Zaima

FOREIGN PATENT DOCUMENTS

JP 07-095406 4/1995
JP 2001292330 10/2001
JP 2006-030564 2/2006

OTHER PUBLICATIONS

U.S. Office Action dated Sep. 1, 2009 corresponding to U.S. Appl. No. 11/618,058, filed Dec. 29, 2006.

*Primary Examiner* — David Gray
*Assistant Examiner* — Ruth Labombard
(74) *Attorney, Agent, or Firm* — Turocy & Watson, LLP

(57) ABSTRACT

A technique that can stably realize highly accurate image adjustment processing regardless of deterioration in an image forming characteristic and the like is provided. An image forming apparatus that forms, on an image formation medium, a gradation pattern formed as an image of density changing according to a gradation step, and performs predetermined image adjustment processing on the basis of a print state of the gradation pattern formed on the image formation medium, the image forming apparatus comprising a fluctuation-information acquiring unit configured to acquire information on a degree of fluctuation in a predetermined characteristic affecting an image quality of an output image; and a control unit configured to form, on the image formation medium, a gradation pattern in which a density changing amount is changed according to the gradation step on the basis of the information acquired by the fluctuation-information acquiring unit.

19 Claims, 9 Drawing Sheets

IMAGE FORMING APPARATUS AND IMAGE ADJUSTING METHOD INVOLVING A FLUCTUATION-INFORMATION ACQUIRING UNIT AND A CONTROL UNIT THAT FORMS A GRADATION PATTERN

CROSS-REFERENCE TO RELATED APPLICATIONS

This application is a Continuation of application Ser. No. 11/618,058 filed Dec. 29, 2006, the entire contents of which is hereby incorporated by reference.

BACKGROUND OF THE INVENTION

1. Field of the Invention

The present invention relates to an image adjustment processing in an image forming apparatus, and, more particularly to improvement of accuracy of image adjustment processing.

2. Description of the Related Art

In recent years, color MFPs are becoming increasingly popular year by year. In particular, since office documents are prepared in color, an increasing number of color copies and prints are used. In the case of the color MFPs, it is more important to always keep colors and densities constant. However, in general, a density characteristic of a printer engine tends to change as time elapses. Thus, some of the color MFPs have a function for gamma automatic adjustment (calibration) to keep colors and gradations as constant as possible.

Specifically, the gamma automatic adjustment is a function of outputting, in general, a pattern of a regular gradation, inputting the pattern with a scanner, calculating an inverse function or the like from a read value, and setting a gamma correction curve for adjusting an output image quality. In general, this gradation pattern for gamma correction is provided by using a gradation pattern in which the density changes from bright to dark, and this gradation pattern is formed such that gradation patches placed at fixed intervals (at fixed density changing amounts) are arranged in the density changing direction.

When, for example, a charging characteristic or the like of a developer is deteriorated and durable lives of consumables are nearly over (life end), a gradient in an intermediate density region of a gamma curve of the printer engine becomes steep and gradation properties in a highlight region (bright region) and a dark region (dark region) tend to be lost.

Even if a correction pattern is outputted in a state in which the gradation properties in the highlight region and the dark region of the printer engine fall in this way, since it is difficult to reproduce gradations in the highlight region and the dark region, a correction curve cannot be calculated accurately. Consequently, it is impossible to perform highly accurate image adjustment.

For example, when an 8-bit signal is equally divided into N to output a pattern as shown in FIG. 10, at the beginning of a printer life, since reproduction of gradations in the highlight region and the dark region can be performed, no problem occurs. However, near a life end, since densities are substantially the same in several gradations from the beginning on the highlight side and in last several gradations on the dark side, it is impossible to calculate an accurate correction value. Actually, a correction value is calculated by performing interpolation or the like. As a result, since a gradation value that cannot actually be reproduced is selected, it is impossible to calculate an accurate correction curve and perform highly accurate image adjustment processing.

SUMMARY OF THE INVENTION

It is an object of an embodiment of the invention to provide a technique that can stably realize highly accurate image adjustment processing regardless of deterioration in an image forming characteristic and the like.

In order to solve the problems, an image forming apparatus according to an aspect of the present invention is an image forming apparatus that forms, on an image formation medium, a gradation pattern formed by a color obtained by mixing colors of coloring agents of plural colors, formed as an image of density changing according to a gradation step, reads a gradation pattern image formed on the image formation medium with a color sensor, and performs predetermined image adjustment processing on the basis of information read, the image forming apparatus including a fluctuation-information acquiring unit configured to acquire information on a degree of fluctuation in a predetermined characteristic affecting an image quality of an output image, and a control unit configured to form, on the image formation medium, a gradation pattern in which a density changing amount is changed according to the gradation step on the basis of the information acquired by the fluctuation-information acquiring unit, and a color sensor that reads the gradation pattern formed on the image formation medium.

An image forming apparatus according to an aspect of the present invention is an image forming apparatus that forms, on an image formation medium, a gradation pattern formed as an image of density changing according to a gradation step, and performs predetermined image adjustment processing on the basis of a print state of the gradation pattern formed on the image formation medium, the image forming apparatus including fluctuation-information acquiring means configured to acquire information on a degree of fluctuation in a predetermined characteristic affecting an image quality of an output image, and control means configured to form, on the image formation medium, a gradation pattern in which a density changing amount is changed according to the gradation step on the basis of the information acquired by the fluctuation-information acquiring unit.

An image adjusting method according to an aspect of the invention is an image adjusting method in an image forming apparatus that forms, on an image formation medium, a gradation pattern formed as an image of density changing according to a gradation step, and performs predetermined image adjustment processing on the basis of a print state of the gradation pattern formed on the image formation medium, the image adjusting method including the steps of acquiring information on a degree of fluctuation in a predetermined characteristic affecting an image quality of an output image, and forming, on the image formation medium, a gradation pattern in which a density changing amount is changed according to the gradation step on the basis of the information acquired in the step of acquiring information of fluctuation.

DESCRIPTION OF THE EMBODIMENT

An embodiment of the invention will be hereinafter explained with reference to the drawings.

Figure 1:
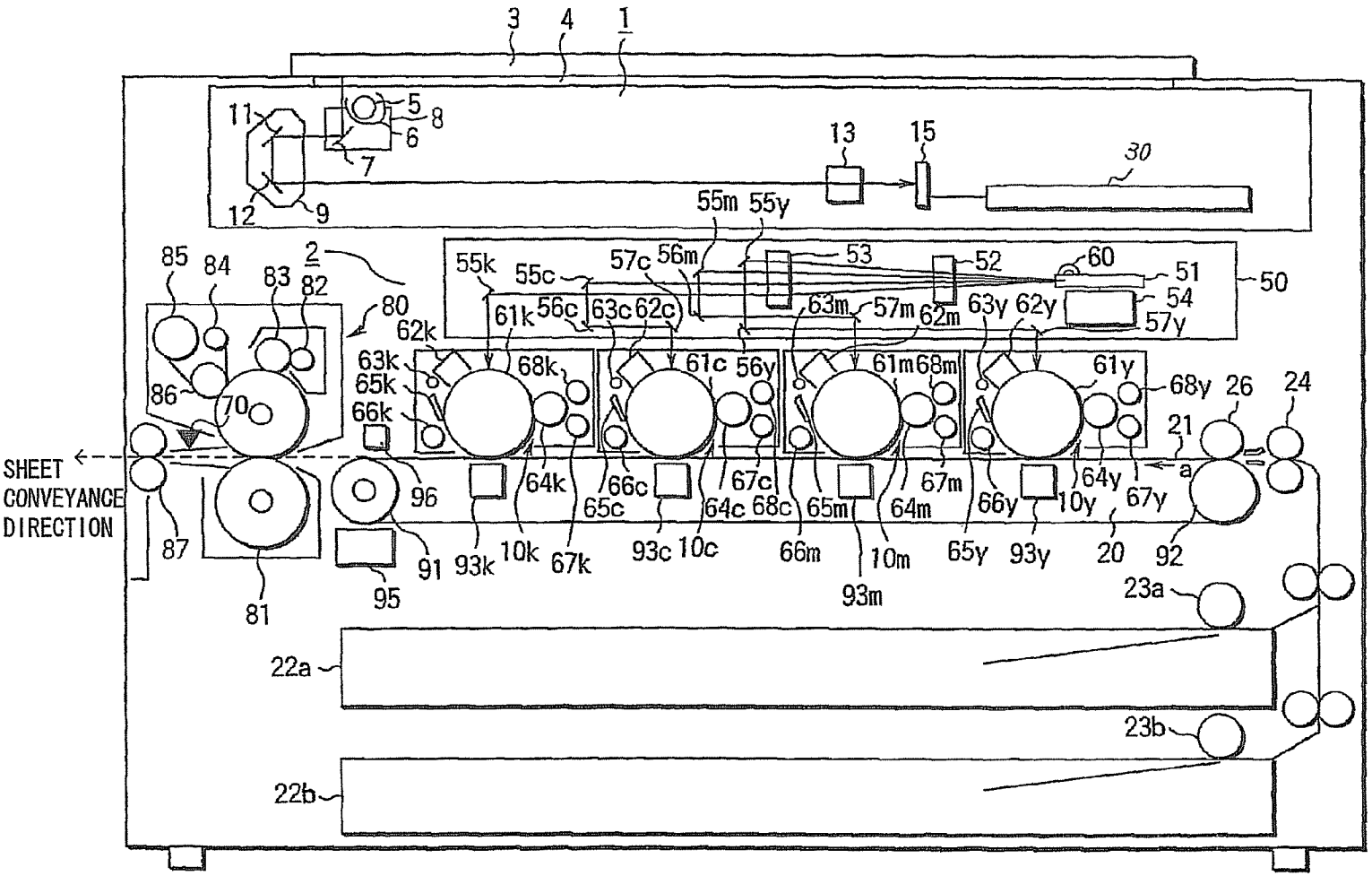
FIG. 1 is a diagram schematically showing an internal structure of an image forming apparatus such as a digital color copying machine that forms a duplicate image of a color image according to an embodiment of the invention.

FIG. 1 schematically shows an internal structure of an image forming apparatus such as a digital color copying machine that forms a duplicate image of a color image according to this embodiment. Roughly speaking, this image forming apparatus includes a color scanner unit 1 serving as image reading means that reads a color image on an original and a color printer unit 2 serving as image forming means that forms a duplicate image of the color image read.

The color scanner unit 1 has an original stand cover 3 in an upper part thereof and has an original stand 4 that is disposed to be opposed to the original stand cover 3 in a closed state and is made of a transparent glass on which an original is set. Under the original stand 4, an exposure lamp 5 that illuminates the original placed on the original stand 4, a reflector 6 for condensing light from the exposure lamp 5 on the original, a first mirror 7 that bends reflected light from the original in a left direction with respect to the surface of the figure, and the like are disposed. The exposure lamp 5, the reflector 6, and the first mirror 7 are fixed to a first carriage 8. The first carriage 8 is driven by a not-shown pulse motor to be moved in parallel along the lower surface of the original stand 4.

On the left side in the figure with respect to the first carriage 8, i.e., in a direction in which light reflected by the first mirror 7 is guided, a second carriage 9 provided to be movable in parallel to the original stand 4 via a not-shown driving mechanism (e.g., a toothed belt and a DC motor) is disposed. A second mirror 11 that bends the reflected light from the original guided by the first mirror 7 downward in the figure and a third mirror 12 that bends the reflected light from the second mirror 11 in the right direction in the figure are arranged at right angles to each other. The second carriage 9 is driven by the first carriage 8 and moved in parallel along the original stand 4 at speed a half of that of the first carriage 8.

A focusing lens 13 that focuses the reflected light from the third mirror 12 at a predetermined magnification is arranged in a plane including an optical axis of the light returned by the second and the third mirrors 11 and 12. A CCD color image sensor (photoelectric conversion element) 15 that converts the reflected light imparted with a focusing property by the focusing lens 13 into electric signals is disposed in a place substantially orthogonal to an optical axis of light transmitted through the focusing lens 13.

Therefore, when the light from the exposure lamp 5 is condensed on the original on the original stand 4 by the reflector 6, the reflected light from the original is made incident on the color image sensor 15 via the first mirror 7, the second mirror 11, the third mirror 12, and the focusing lens 13. The incident light is converted into electric signals corresponding to the three primary colors of light, R (red), G (green), and B (blue), in the color image sensor 15.

The color printer unit 2 has first to fourth image forming units 10*y*, 10*m*, 10*c*, and 10*k* that form images subjected to color separation for respective color components on the basis of the known subtractive color mixture method, i.e., images of four colors, yellow (y), magenta (m), cyan (c), and black (k).

A conveying mechanism 20 including a conveyor belt 21 serving as conveying means that conveys images of respective colors formed by the respective image forming units in an arrow "a" direction in the figure is disposed below the respective image forming units 10*y*, 10*m*, 10*c*, and 10*k*. The conveyor belt 21 is wound around and tensed between a driving roller 91 rotated in the arrow "a" direction by a not-shown motor and a driven roller 92 spaced apart from the driving roller 91 by a predetermined distance. The conveyor belt 21 is endlessly moved in the arrow "a" direction at constant speed. The respective image forming units 10*y*, 10*m*, 10*c*, and 10*k* are disposed in series along a conveyance direction of the conveyor belt 21.

The respective image forming units 10*y*, 10*m*, 10*c*, and 10*k* include photoconductive drums 61*y*, 61*m*, 61*c*, and 61*k* serving as image bearing members, outer peripheral surfaces of which are formed to be rotatable in an identical direction in positions in contact with the conveyor belt 21. The respective photoconductive drums 61*y*, 61*m*, 61*c*, and 61*k* are rotated at predetermined speed by a not-shown motor.

The respective photoconductive drums 61*y*, 61*m*, 61*c*, and 61*k* are disposed such that axes thereof are spaced apart from one another at equal intervals and the axes are orthogonal to the direction in which the images are conveyed by the conveyor belt 21. In the following explanation, an axial direction of the respective photoconductive drums 61*y*, 61*m*, 61*c*, and 61*k* are set as a main scanning direction (a second direction) and a rotation direction of the photoconductive drums 61*y*, 61*m*, 61*c*, and 61*k*, i.e., a rotation direction of the conveyor belt 21 (the arrow "a" direction in the figure) is set as a sub-scanning direction (a first direction).

Around the respective photoconductive drums 61*y*, 61*m*, 61*c*, and 61*k*, charging devices 62*y*, 62*m*, 62*c*, and 62*k* serving as charging means extended in the main scanning direction, charge removing devices 63*y*, 63*m*, 63*c*, and 63*k*, developing rollers 64*y*, 64*m*, 64*c*, and 64*k* serving as developing means also extended in the main scanning direction, lower agitation rollers 67*y*, 67*m*, 67*c*, and 67*k*, upper agitation rollers 68*y*, 68*m*, 68*c*, and 68*k*, transferring devices 93*y*, 93*m*, 93*c*, and 93*k* serving as transferring means also extended in the main scanning direction, cleaning blades 65*y*, 65*m*, 65*c*, and 65*k* also extended in the main scanning direction, and waste toner collection screws 66*y*, 66*m*, 66*c*, and 66*k* are arranged in order along the rotation direction of the photoconductive drums 61*y*, 61*m*, 61*c*, and 61*k*.

The respective transferring devices 93*y*, 93*m*, 93*c*, and 93*k* are disposed in positions where the conveyor belt 21 is held between the transferring devices and the photoconductive drums 61*y*, 61*m*, 61*c*, and 61*k* corresponding to the transferring devices, i.e., on the inner side of the conveyor belt 21. Exposure points of exposure by an exposing device 50 which is described later are formed on outer peripheral surfaces of the photoconductive drums 61*y*, 61*m*, 61*c*, and 61*k* between the charging devices 62*y*, 62*m*, 62*c*, and 62*k* and the developing rollers 64*y*, 64*m*, 64*c*, and 64*k*, respectively.

Below the conveying mechanism 20, sheet cassettes 22*a* and 22*b* in which plural sheets P serving as image formation media, onto which images formed by the respective image forming units 10*y*, 10*m*, 10*c*, and 10*k* are transferred, are stored are arranged.

Pickup rollers 23*a* and 23*b* that take out the sheets P stored in the sheet cassettes 22*a* and 22*b* one by one from the top are arranged at one ends of the sheet cassettes 22*a* and 22*b* and on a side close to the driven roller 92. Register rollers 24 for aligning the leading end of the sheet P taken out from the sheet cassettes 22*a* and 22*b* and the leading end of a "y" toner image formed on the photoconductive drum 61*y* of the image forming unit lay are arranged between the pickup rollers 23*a* and 23*b* and the driven roller 92.

Toner images formed on the other photoconductive drums 61*y*, 61*m*, and 61*c* are supplied to respective transfer positions to be timed to coincide with conveyance timing of the sheet P conveyed on the conveyor belt 21.

An attracting roller 26 for imparting an electrostatic attracting force to the sheet P conveyed at predetermined timing via the registration rollers 24 is disposed between the registration rollers 24 and the first image forming unit lay and near the driven roller 92, i.e., substantially on the outer peripheral of the driven roller 92 across the conveyer belt 21. An axis of the attracting roller 26 and an axis of the driven roller 92 are set to be parallel to each other.

A positional deviation sensor 96 for detecting a position of an image formed on the conveyor belt 21 is disposed at one end of the conveyor belt 21 and near the driving roller 91, i.e., substantially on the outer periphery of the driving roller 91 across the conveyor belt 21.

The positional deviation sensor 96 is constituted by, for example, a transmissive or reflective optical sensor.

A conveyor belt cleaning device 95 for removing a toner adhering on the conveyor belt 21, paper dust of the sheet P, or the like is disposed on the outer periphery of the driving roller 91 and on the conveyor belt 21 on the downstream side of the positional deviation sensor 96.

A fixing device 80 that melts a toner image transferred onto the sheet P by heating the sheet P to a predetermined temperature and fixes the toner image on the sheet P is disposed in a direction in which the sheet P conveyed via the conveyor belt 21 is separated from the driving roller 91 and further conveyed. The fixing device 80 includes a heat roller pair 81, oil applying rollers 82 and 83, a web winding roller 84, a web roller 85, and a web pressing roller 86. On the downstream side of the fixing device 80 in the sheet conveyance direction, a color sensor 70 for optically reading an image formed on a sheet (in particular, a gradation pattern image described later) is arranged. The sheet P having the toner image heated and fixed thereon by the fixing device 80 is discharged by a paper discharge roller pair 87.

The exposing device 50 that forms electrostatic latent images subjected to color separation on the outer peripheral surfaces of the respective photoconductive drums 61*y*, 61*m*, 61*c*, and 61*k* has a semiconductor laser oscillator 60 controlled to emit light on the basis of image data (Y, M, C, and K) of respective colors subjected to color separation by an image processing device 36 described later. A polygon mirror 51 that reflects laser beams and uses the laser beams for scanning and is rotated by a polygon motor 54 and fθ lenses 52 and 53 for correcting focuses of the laser beams reflected via the polygon mirror 51 and focusing the laser beams are provided in order on an optical path of the semiconductor laser oscillator 60.

First return mirrors 55*y*, 55*m*, 55*c*, and 55*k* that bend the laser beams of the respective colors transmitted through the fθ lens 53 toward exposure positions of the respective photoconductive drums 61*y*, 61*m*, 61*c*, and 61*k*, and second and third return mirrors 56*y*, 56*m*, 56*c*, 57*y*, 57*m*, and 57*c* that further bend the laser beams bent by the first return mirrors 55*y*, 55*m*, and 55*c* are arranged between the fθ lens 53 and the respective photoconductive drums 61*y*, 61*m*, 61*c*, and 61*k*.

The laser beam for black is returned by the first return mirror 55*k* and then guided onto the photoconductive drum 61*k* without passing through the other mirrors.

Figure 2:
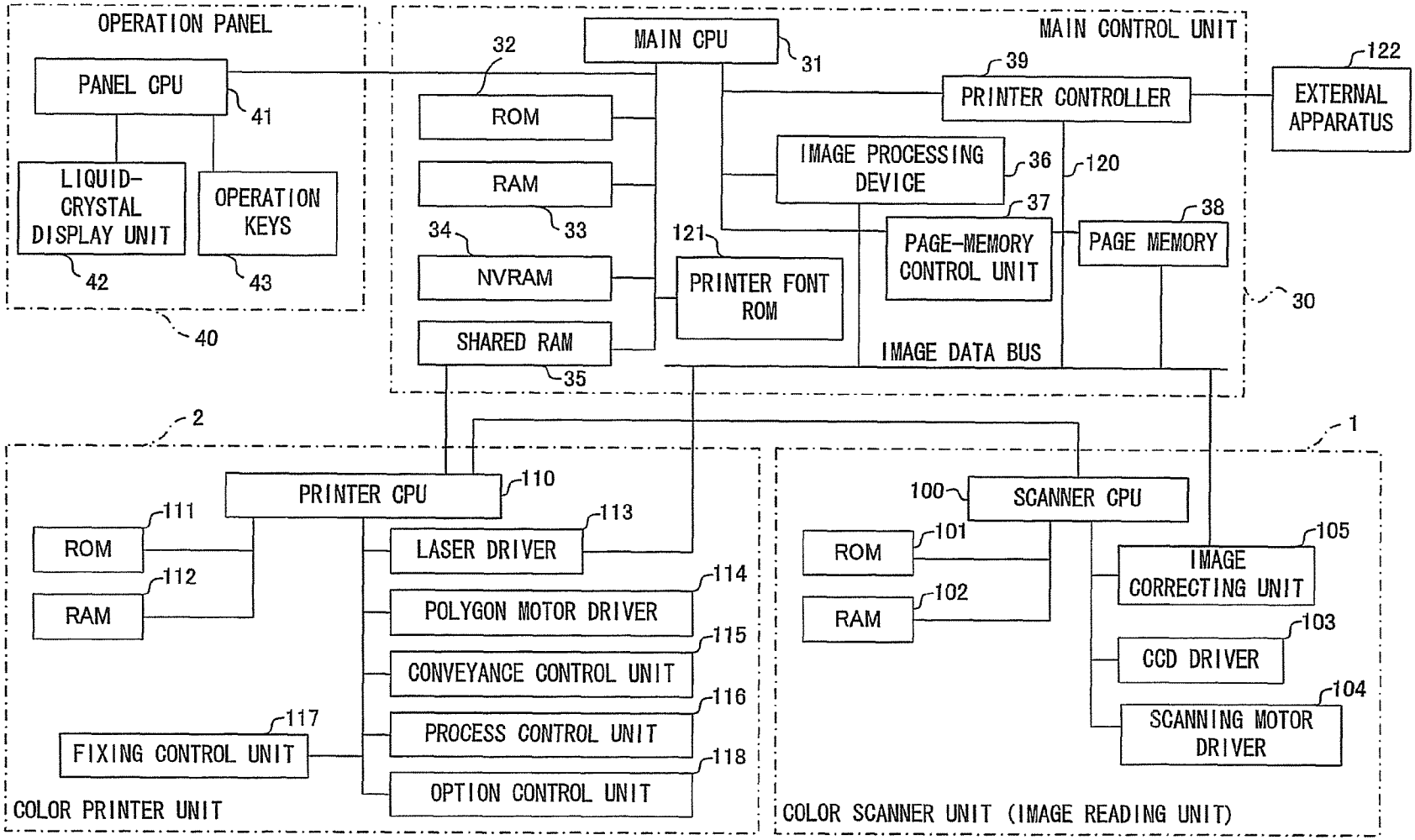
FIG. 2 is a block diagram schematically showing a flow of a signal for electric connection and control of the digital copying machine shown in FIG. 1.

FIG. 2 is a block diagram schematically showing a flow of a signal for electric connection and control of the digital copying machine shown in FIG. 1. In FIG. 2, a control system includes three CPUs, namely, a main CPU (central processing unit) 91 in a main control unit 30, a scanner CPU 100 of the color scanner unit 1, and a printer CPU 110 of the color printer unit 2.

The main CPU 91 performs bidirectional communication with the printer CPU 110 via a shared RAM (random access memory) 35. The main CPU 91 issues an operation instruction and the printer CPU 110 returns a status. The printer CPU 110 and the scanner CPU 100 perform serial communication. The printer CPU 110 issues an operation instruction and the scanner CPU 100 returns a status.

An operation panel 40 has a liquid-crystal display unit 42, various operation keys 43, and a panel CPU 41 connected to the liquid-crystal display unit 42 and the operation keys 43. The operation panel 40 is connected to the main CPU 91.

The main control unit 30 includes the main CPU 91, a ROM (read only memory) 32, a RAM 33, an NVRAM 34, the shared RAM 35, the image processing device 36, a page-memory control unit 37, a page memory 38, a printer controller 39, and a printer font ROM 121.

The main CPU 91 manages overall control. The ROM 32 has stored therein a control program and the like. The RAM 33 temporarily stores data.

The NVRAM (nonvolatile RAM) 34 is a nonvolatile memory backed up by a battery (not shown) and holds stored data even if a power supply is isolated.

The shared RAM 35 is used for performing bidirectional communication between the main CPU 91 and the printer CPU 110. The page-memory control unit 37 stores image information in the page memory 38 and reads out the image information from the page memory 38. The page memory 38 has an area in which image information for plural pages can be stored. The page memory 38 is formed to be capable of storing, for each page, data obtained by compressing image information from the color scanner unit 1.

Font data corresponding to print data is stored in the printer font ROM 121. The print controller 39 expands printer data from an external apparatus 122 such as a personal computer into image data using the font data stored in the printer font ROM 121 at a resolution corresponding to data indicating a resolution given to the printer data.

The color scanner unit 1 includes the scanner CPU 100 that manages overall control, a ROM 101 having stored therein a control program and the like, a RAM 102 for data storage, a CCD driver 103 that drives the color image sensor 15, a scanning motor driver 104 that controls rotation of a scanning motor for moving the first carriage 8 and the like, and an image correcting unit 105.

The image correcting unit 105 includes an A/D conversion circuit that converts analog signals of R, G, and B outputted from the color image sensor 15 into digital signals, respectively, a shading correction circuit for correcting fluctuation in a threshold level with respect to an output signal from the color image sensor 15 due to variation in the color image sensor 15 or an ambient temperature change, and a line memory that temporarily stores a digital signal subjected to shading correction from the shading correction circuit.

The color printer unit 2 includes the printer CPU 110 that manages overall control, a ROM 111 having stored therein a control program and the like, a RAM 112 for data storage, a laser driver 113 that drives the semiconductor laser oscillator 60, a polygon motor driver 114 that drives the polygon motor 54 of the exposing device 50, a conveyance control unit 115 that controls the conveyance of the sheet P by the conveying mechanism 20, a process control unit 116 that controls processes for performing charging, development, and transfer using the charging device, the developing roller, and the transferring device, a fixing control unit 117 that controls the fixing device 80, and an option control unit 118 that controls options.

The image processing unit 36, the page memory 38, the printer controller 39, the image correcting unit 105, and the laser driver 113 are connected by an image data bus 120.

An image adjusting method in the image forming apparatus according to this embodiment will be explained.

Figure 3:
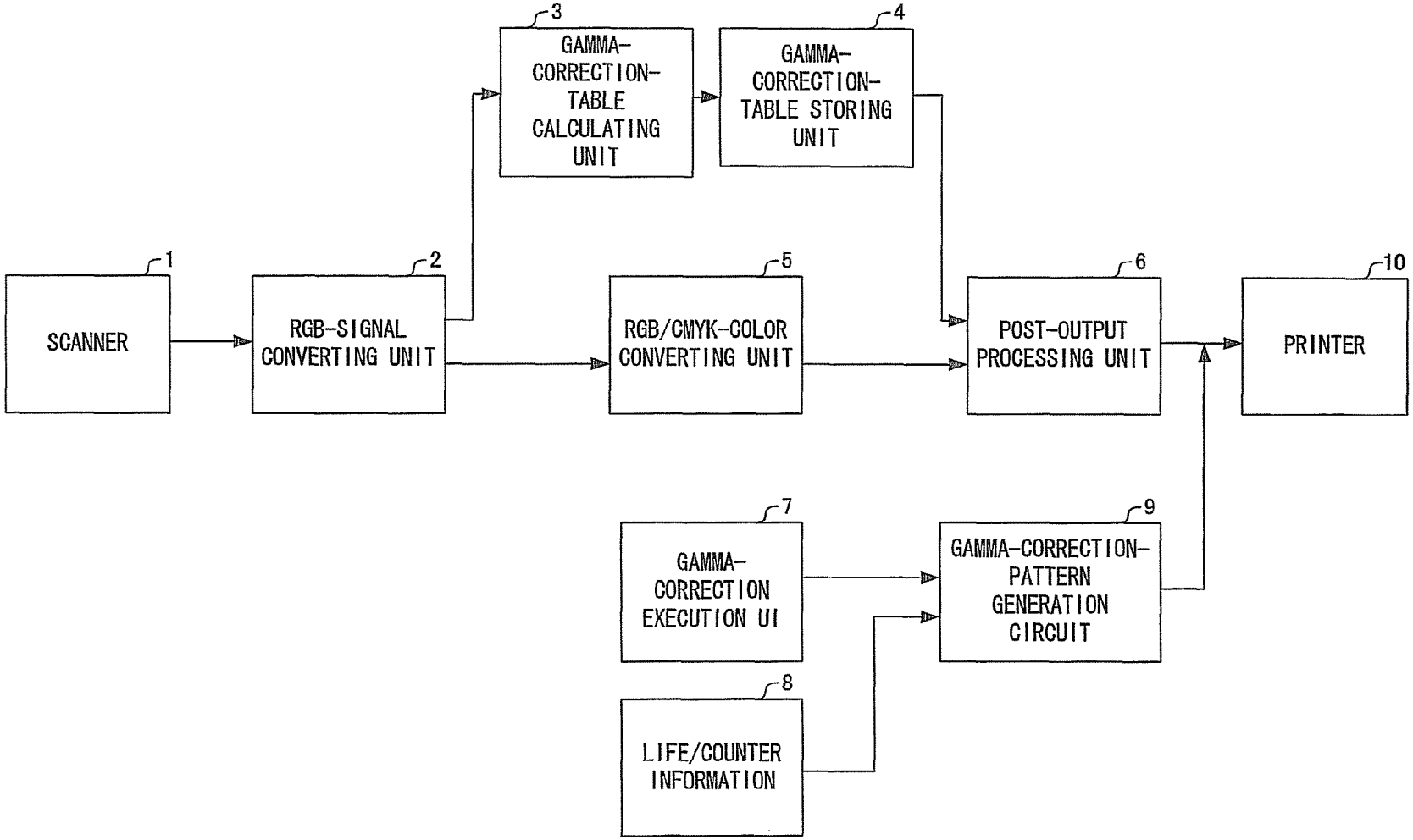
FIG. 3 is a diagram showing a processing flow of the invention.
Figure 4:
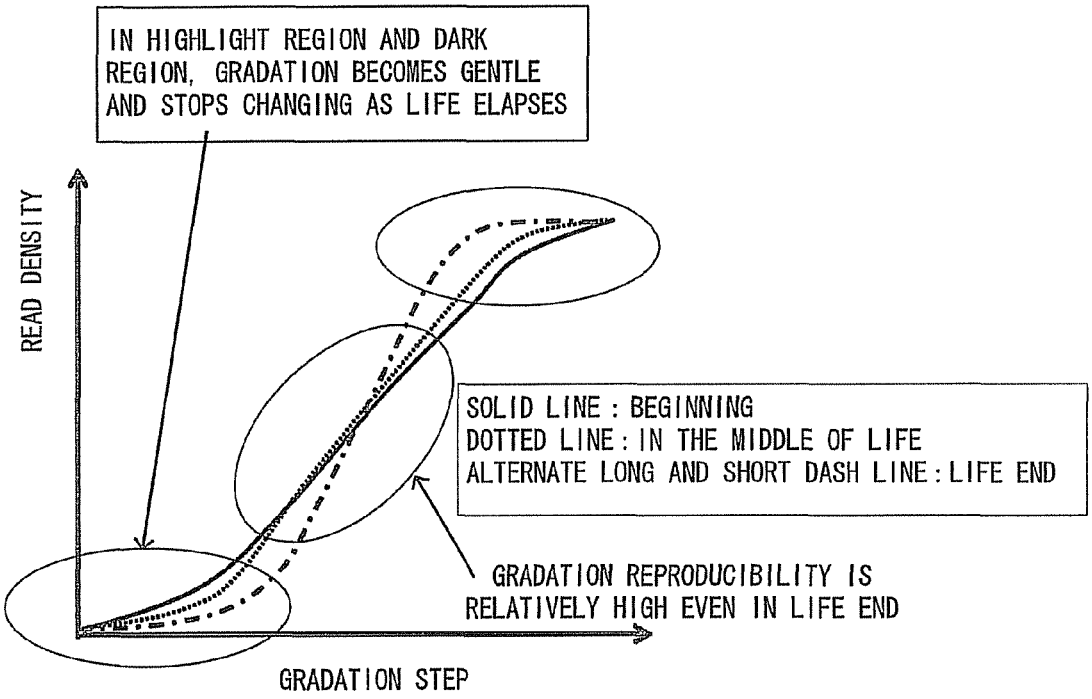
FIG. 4 is a diagram for explaining a characteristic of a gamma curve.
Figure 5:
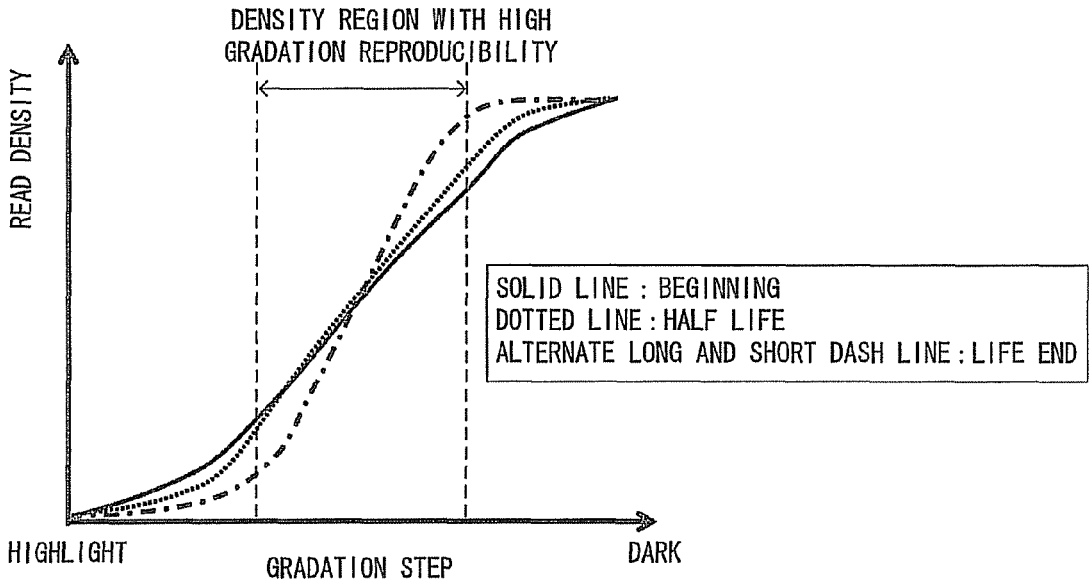
FIG. 5 is a diagram showing a gradation dividing method in the embodiment.
Figure 6:
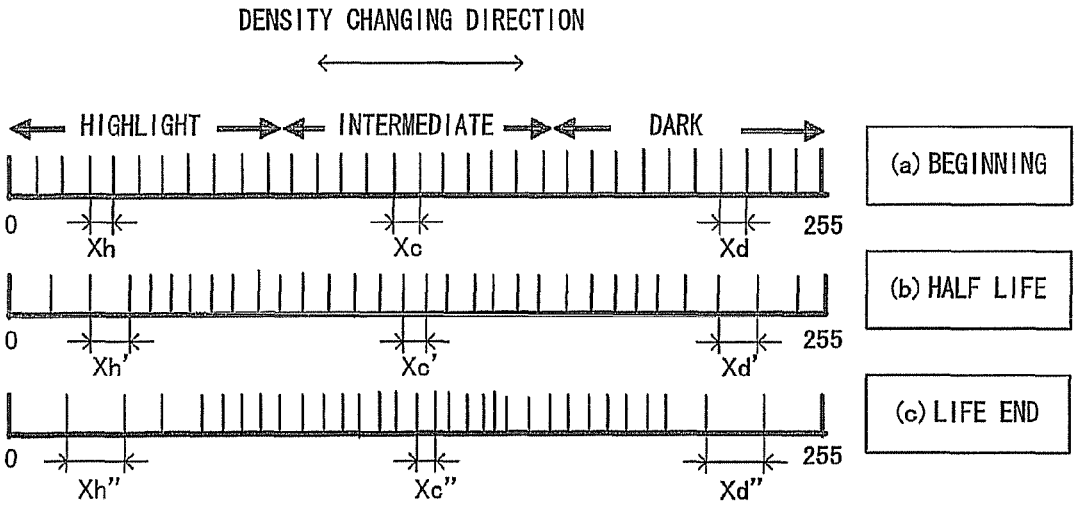
FIG. 6 is a diagram showing the gradation dividing method in the embodiment.
Figure 7:
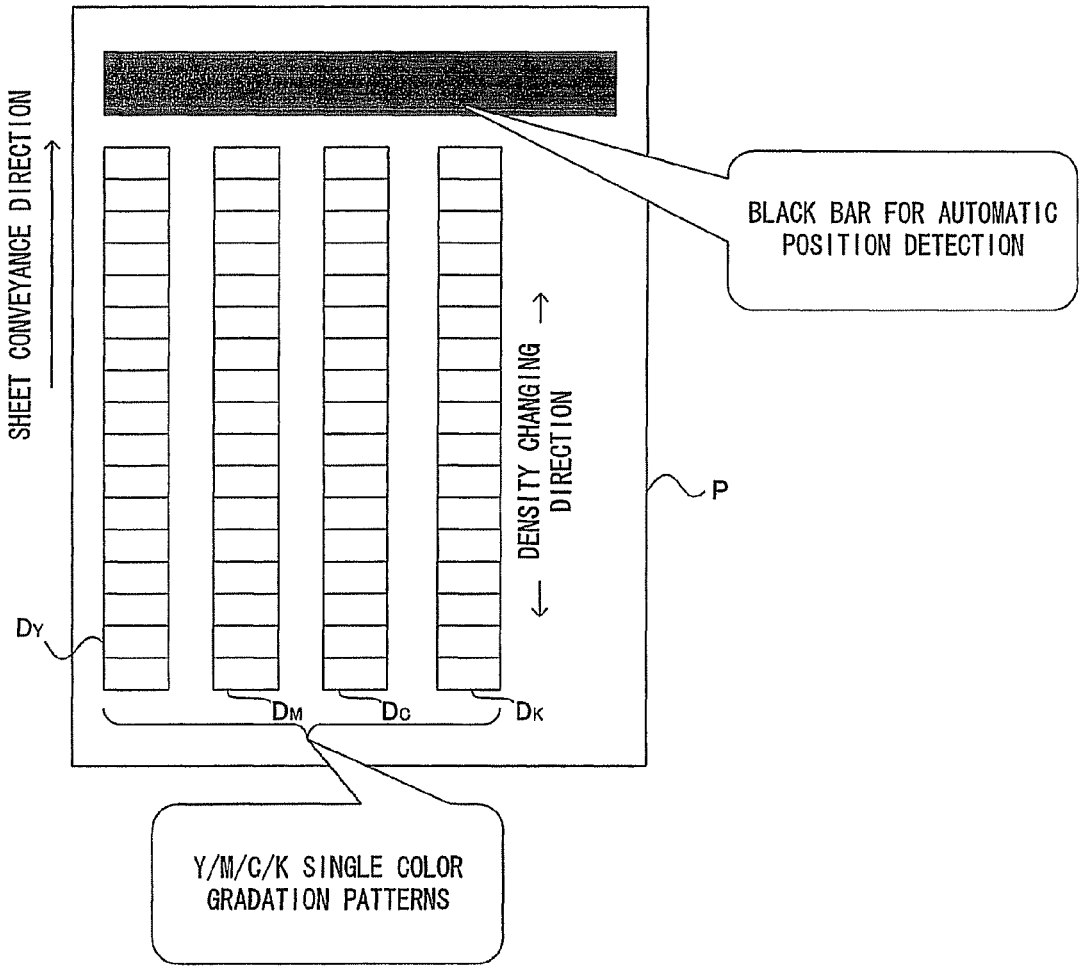
FIG. 7 is a diagram showing an example of a gradation pattern for gamma correction used in the embodiment.

FIG. 3 is a diagram showing a processing flow of this embodiment. FIG. 4 is a diagram for explaining a characteristic of a gamma curve. FIGS. 5 and 6 are diagrams showing a gradation dividing method in this embodiment. FIG. 7 is a diagram showing an example of a gradation pattern for gamma correction used in this embodiment.

A flow of gamma automatic adjustment (predetermined quality adjustment processing) will be explained using FIG. 3.

(1) Output of a gradation pattern for gamma correction is instructed by a gamma-correction-execution UI unit 7.

As shown in FIG. 7, this pattern is formed by four patterns, namely, a gradation patch $D_Y$ formed by a yellow toner, a gradation patch $D_M$ formed by a magenta toner, a gradation patch $D_C$ formed by a cyan toner, and a gradation patch $D_K$ formed by a black toner. These gradation patterns are formed such that densities of the gradation patterns change in the sheet conveyance direction (the sub-scanning direction)

Black bars for automatically discriminating positions of the gradation patches on the sheet P are added to the front of the four gradation patterns.

A gamma-correction-pattern generation circuit (equivalent to a fluctuation-information acquiring unit and a control unit) 9 acquires, before pattern output, information such as information indicating the number of outputs of M/C, temperature, humidity, a degree of deterioration in consumables and life information of respective individual consumables (information on a degree of fluctuation in a predetermined characteristic affecting an image quality of an output image) from a life/counter information unit 8 (a fluctuation-information acquiring step), selects a gradation pattern corresponding to the information out of plural gradation patterns stored in a memory area in advance, and outputs a gradation pattern image shown in FIG. 7 using a printer 10 (a control step).

A gamma-correction-pattern generation circuit 9 causes density changing in order from zeroth to 255th gradation steps in 256 gradation steps.

For example, at the beginning of printing (a state in which respective characteristics (a charging characteristic of a developer, etc.) in a printer engine is hardly deteriorated), when a horizontal axis represents the zeroth to 255th gradation steps as shown in FIG. 6A, a density changing amount (Xh) in gradation steps on a High Light side, a density changing amount (Xc) in gradation steps of an Intermediate region, and a density changing amount (Xd) in gradation steps on a Dark side are identical as shown in an upper diagram of FIG. 6A.

In a lower diagram of FIG. 6A, a vertical axis represents the density for the zeroth to 255th gradation steps, and the density increases gradually as the gradation step increases with the density changing amount (Xh) in the gradation steps on the High Light side. Similarly, in the gradation steps of the Intermediate region, the density increases as the gradation step increases with the density changing amount (Xc). Also, in the gradation steps on the Dark side, the density increases as the gradation step increases with the density changing amount (Xd).

In other words, at the beginning of printing, the density in the 256 gradation steps from the High Light side to the Dark side is outputted with the constant density changing amount.

The gamma-correction-pattern generation circuit 9 may output the gradation pattern in accordance with the gradation steps and the density changing amount shown in FIG. 6A at the beginning of printing. However, as shown in FIG. 7, the gradation pattern for each color is formed, for example by thinning-out to 17 gradation patches $D_Y$, $D_M$, $D_C$, and $D_K$, with equal density differences, without outputting the 256 gradation steps of density changing from the zeroth to 255th gradation steps.

Near a half life, as shown in FIG. 6B, taking into account a gamma curve becoming slightly vertical (see FIG. 4), a density changing amount (Xh') from zeroth to, for example, 50th gradation steps on the High Light side is set to be greater than a density changing amount (Xc') in the Intermediate region, for example, from 51st to 200th gradation steps, and similarly, a density changing amount (Xd'), for example, from 201st to 255th gradation steps on the Dark side is set to be greater than the density changing amount (Xc') in the gradation steps of the Intermediate region as shown in FIG. 6B.

In other words, as shown in a lower diagram of FIG. 6B, output is performed with a greater density change than that at the beginning of printing shown in FIG. 6A from the zeroth to 50th gradation steps. Thus, the densities of the gradation patches can be individually identified and read on the High Light side. Similarly, the densities of the gradation patches can be individually identified and read on the Dark side.

Near a life end (durable lives of consumables are over), since the gamma curve becomes more vertical (see FIG. 4), as shown in FIG. 6C, a density changing amount (Xh") from zeroth to 50th gradation steps on the High Light side is set to be greater than a density changing amount (Xc") from 51st to 200th gradation steps in the Intermediate region, and similarly, a density changing amount (Xd") from 201st to 255th gradation steps on the Dark side is set to be greater than the density changing amount (Xc") in the gradation steps of the Intermediate region. These density changing amounts (Xh"), (Xd") are set to be greater than the density changing amount (Xh') in the gradation steps of the density region on the High Light side and the density changing amount (Xd') in the gradation steps of the density region on the Dark Side for the half life in FIG. 6B, respectively. In contrast, the density changing amount (Xc") in the Intermediate region is set to be smaller than the density changing amount (Xc') in the gradation steps of the Intermediate region for the half life in FIG. 6B.

In other words, as shown in a lower diagram of FIG. 6C, since the density changing amount on the High Light side is larger than that for the half life, the densities of the gradation patches can be individually identified and read. Similarly, since the density changing amount on the Dark side is larger, the densities of the gradation patches can be individually identified and read on the Dark side.

(2) The gradation pattern image outputted by the printer unit 10 is read by the scanner 1 or the color sensor 70 (an image reading unit). Moreover, a signal is converted into RGB by an RGB-signal converting unit 2.

(3) An average of input values of respective patches of YMC is calculated by a gamma-correction-table calculating unit 3. Reading is calculated using values of complementary color signals of the respective colors, for example, a B signal for Y, a G signal for M, and an R signal for C. For K, a value of a G signal is used in the case of a 3-line CCD and a value of a K signal is used in the case of a 4-line CCD.

An inverse function curve for image adjustment is calculated from the value read by the gamma-correction-table calculating unit 3 using the least square method (a correction curve calculating step). For example, as shown in FIG. 4, a gamma correction curve at the time when the durable lives of the consumables are over (life end) is as indicated by an alternate long and short dash line.

(4) The gamma correction curve calculated as described above is stored in a gamma-correction-table storing unit 4.

(5) In the case of normal copying, in carrying out post-output processing 6, the gradation pattern image is outputted to the printer unit after being subjected to gamma correction using a value of the gamma-correction-table storing unit 4.

As described above, the image forming apparatus according to this embodiment forms a gradation pattern on a sheet and performs predetermined image adjustment processing on the basis of a print state of the gradation pattern formed. With the image adjustment processing, it is possible to change a pattern for gamma correction according to durable lives of consumables and environmental fluctuation in the printer engine.

Therefore, compared with the case in which all gradation patterns are outputted uniformly as in the past, it is possible to form the gradation patches with larger density changing amounts in a section having larger fluctuation. This makes it possible to calculate an accurate correction value conforming to an actual situation.

The number of gradations (a total number of patches) in a gradation pattern is always fixed regardless of intervals of the pattern and durable lives. Thus, it is possible to calculate a gamma correction curve without increasing or decreasing memories and data tables according to the number of patches of the gradation pattern.

Figure 8:
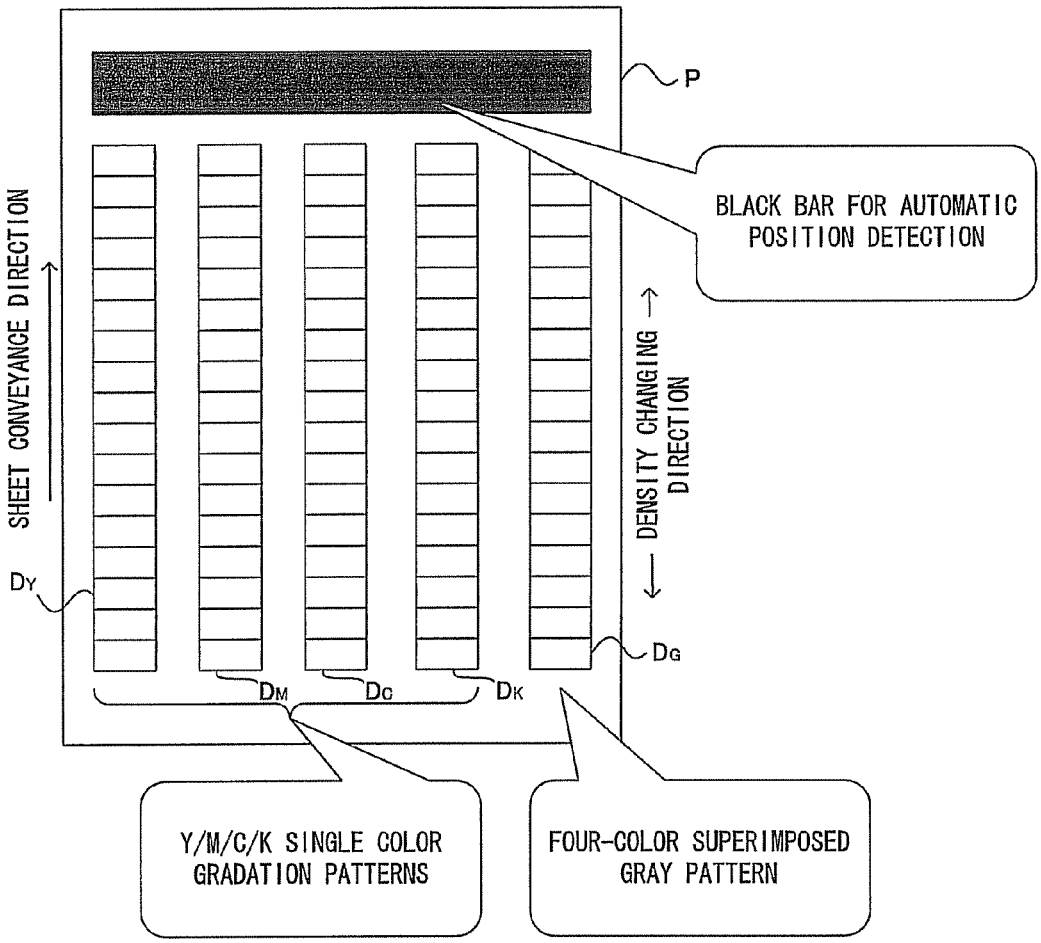
FIG. 8 is a diagram showing a state in which a gray tone pattern formed by mixing colors of toners of four colors is formed in addition to four gradation pattern images.

As shown in FIG. 8, in addition to the four gradation pattern images shown in FIG. 7, a gray tone pattern formed by mixing the colors of the toners of four colors may be formed. In this case, it is also possible to change a patch arrangement after checking a gray balance with a color sensor. In other words, it is also possible to read, after outputting the gradation pattern images shown in FIG. 8, chromaticity information with the scanner 1, output the gradation pattern images again with patch allocation changed for a single color gradation pattern in a section of a color causing loss of a gray balance, and perform normal gamma correction.

In this way, it is preferable that gradation pattern used for the gamma correction processing in this embodiment includes at least one of a gradation pattern formed by a color obtained by mixing colors of toners of plural colors and a gradation pattern formed by a single color.

In the example explained in the embodiment, a gradation pattern image printed on a sheet is stored in the memory area in advance according to a degree of deterioration in a gamma characteristic in the printer engine. However, the invention is not limited to this. The density changing amount may be set (calculated) on the basis of information acquired in the fluctuation-information acquiring unit every time a gradation pattern image is outputted.

Figure 9:
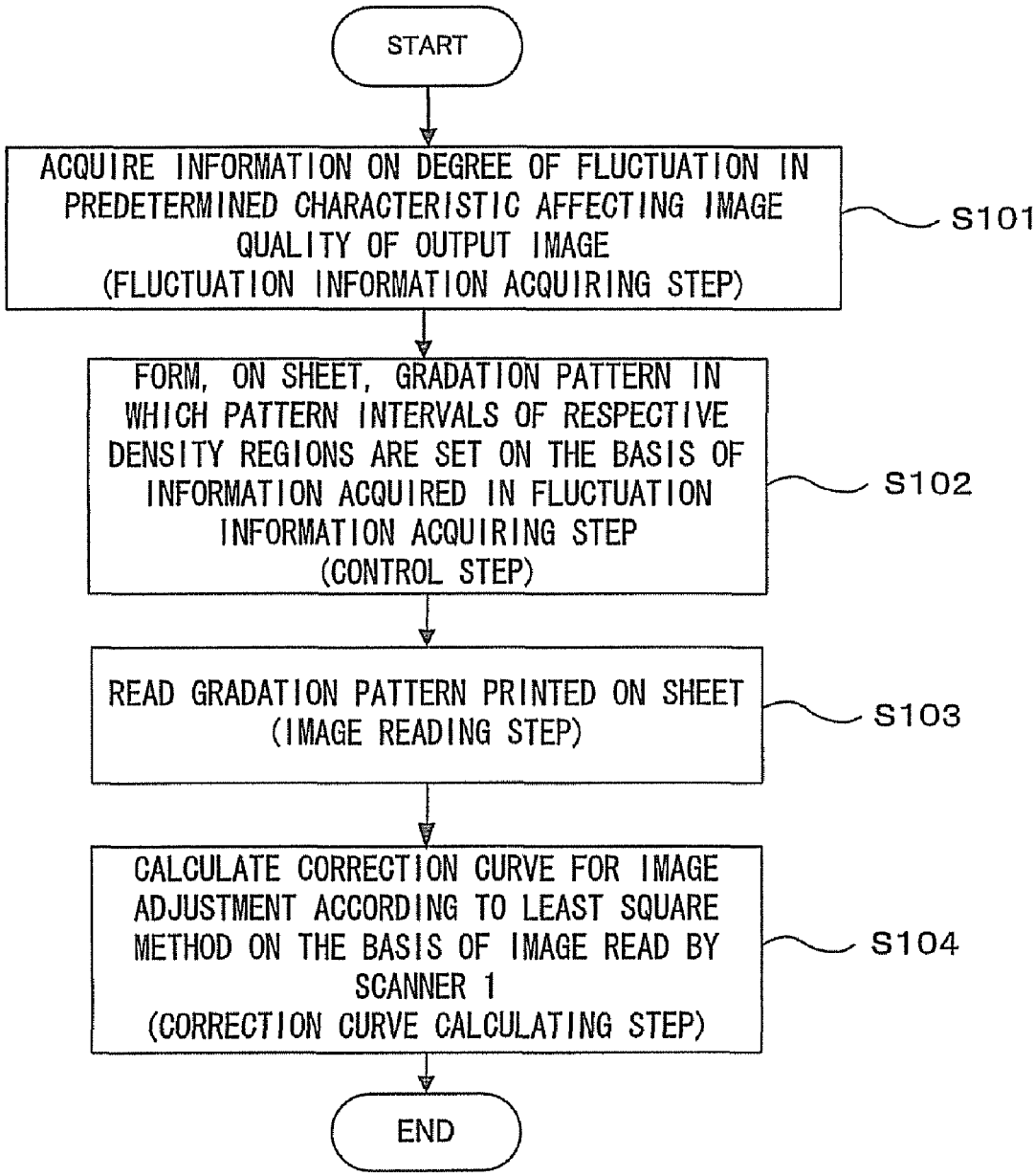
FIG. 9 is a flowchart for explaining a rough flow of processing (an image adjusting method) in the image forming apparatus according to the embodiment.
Figure 10:
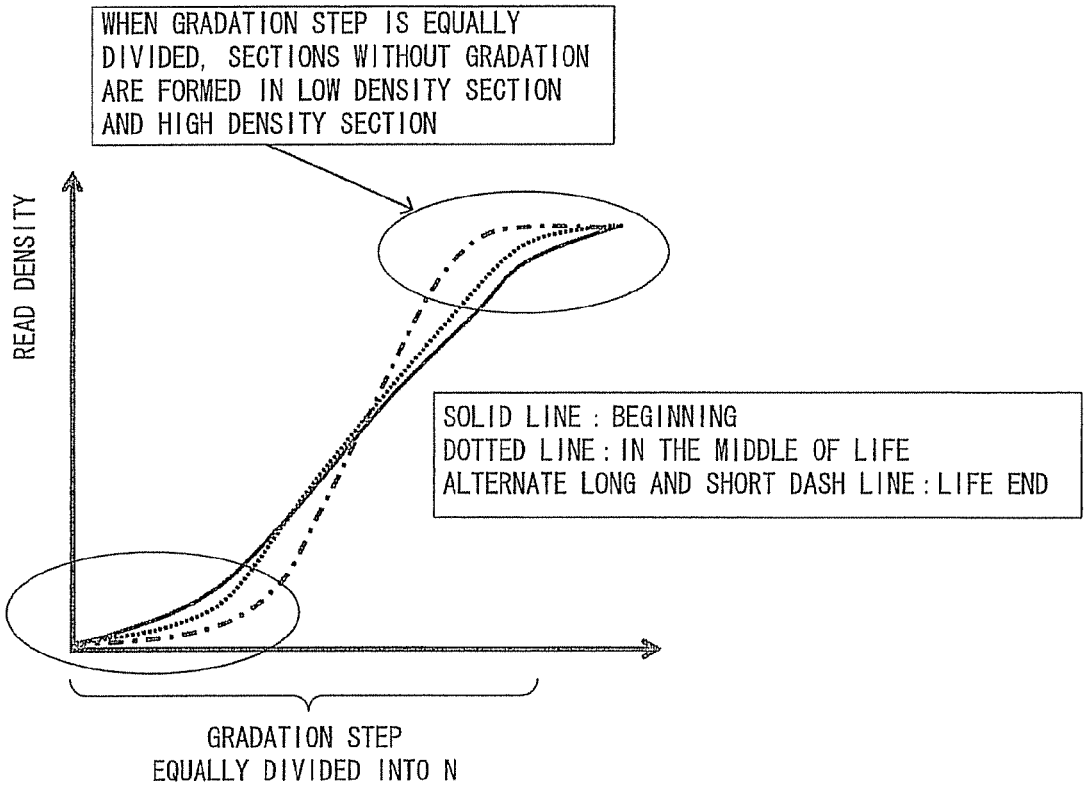
FIG.10 PRIOR ART
FIG. 10 is a diagram for explaining a conventional gradation pattern for gamma correction.

FIG. 9 is a flowchart for explaining a rough flow of processing (an image adjusting method) in the image forming apparatus according to this embodiment.

The gamma-correction-pattern generation circuit 9 (the fluctuation-information acquiring unit) acquires information on a degree of fluctuation in a predetermined characteristic affecting an image quality of an output image (a fluctuation information acquiring step) (S101).

The gamma-correction-pattern generation circuit 9 (the control unit) selects, on the basis of the information acquired in the fluctuation-information acquiring step, a gradation pattern associated with that information out of plural gradation patterns in which different density changing amounts are set according to gradation steps, and forms gradation patches from the selected pattern on a sheet (a control step) (S102).

The scanner 1 (the image reading unit) reads the gradation pattern printed on the sheet (an image reading step) (S103).

The gamma-correction-table calculating unit 3 (the correction-curve calculating unit) calculates a correction curve for image adjustment according to the least square method on the basis of the image read by the scanner 1 (a correction curve calculating step) (S104).

The respective steps in the processing (the image adjusting method) in the image forming apparatus are realized by causing the CPUs (the main CPU 31, the panel CPU 41, the scanner CPU 100, and the printer CPU 110) to execute an image adjusting program stored in the memories (the ROM 32, the RAM 33, the ROM 101, the RAM 102, the ROM 111, the RAM 112, the NVRAM 34, and the shared RAM 35).

In the explanation of this embodiment, the function of carrying out the invention is recorded in the apparatus in advance. However, the invention is not limited to this. The same function may be downloaded from a network to the apparatus or the same function stored in a recording medium may be installed in the apparatus. A form of the recording medium may be any form as long as the recording medium is a recording medium that is capable of storing a program and readable by the apparatus such as a CD-ROM. The function obtained by installation or download in advance in this way may be realized in cooperation with an OS (operating system) and the like in the apparatus.

The above explanation of the invention indicates an example of the invention and is not limited to this. For example, in the example, a gamma curve that changes according to a life is empirically grasped in advance and the density changing amount is changed according to the gradation steps with reference to a value of a number-of-output counter. However, rather than using an empirical value, it is also possible to output and read a gradation pattern based on a gradation pattern with equal density changing amounts in all gradation steps once, check an actual amount of fluctuation in the engine from a read value, and then the density changing amount according to the gradation steps is changed again to output a gradation pattern.

As described above, according to this embodiment, it is possible to change a gradation pattern for gamma correction according to a degree of deterioration in consumables, fluctuation in an engine characteristic, and the like in the printer engine. Consequently, compared with the case in which all gradation patterns are outputted uniformly as in the past, it is possible to set the larger density changing amount to a section having larger fluctuation (a density region having higher gradation reproducibility). This makes it possible to calculate an accurate correction value conforming to an actual situation.

In the example explained in the embodiment, the image forming apparatus is of the type in which the images of the color toners Y, M, C, and K serving coloring agents are transferred onto the sheets P serving as the image formation medium. It is also possible to use an image forming apparatus of a type in which images of Y, M, C, and K are transferred onto an image transferring belt serving as the image formation medium and a color image borne on the image bearing belt is transferred to sheet P at a secondary transferring position. In this case, a gradation patter for gamma correction is formed on the image transferring belt instead of the sheet P serving as the image formation medium. It is possible to employ a type in which a color image on the image bearing belt is read with a color sensor placed, for example, forward of the secondary transferring position, or a type in which a gradation pattern is transferred to a sheet P at the secondary transferring position and the fixed gradation pattern sheet for gamma correction fixed by a fixing device is read by a scanner. The gradation pattern for gamma correction may have a mixed color or a single color.

In addition, the present invention may be applied to an inkjet printer in which an ink serving as a coloring agent is formed on a sheet by an ink head. In this case, it is possible to employ a type in which a gradation pattern for gamma correction of a mixed color or a single color formed on the sheet is automatically read with a color sensor, or a type in which the gradation pattern for gamma correction is read by manual feeding to a scanner included by the inkjet printer.

The invention has been explained in detail using the specific form. However, it would be obvious for those skilled in the art that various alterations and modifications can be made without departing from the spirit and the scope of the invention.

As described above in detail, according to the invention, it is possible to provide a technique that can stably realize highly accurate image adjustment processing regardless of deterioration in an image forming characteristic and the like.

What is claimed is:

1. An image forming apparatus that forms, on an image formation medium, a gradation pattern formed by a color obtained by mixing colors of coloring agents of plural colors, formed as an image of density changing according to a gradation step, reads a gradation pattern image formed on the image formation medium with a color sensor, and performs predetermined image adjustment processing on the basis of information read, the image forming apparatus comprising:

a fluctuation-information acquiring unit configured to acquire information on a degree of fluctuation in a predetermined characteristic affecting an image quality of an output image;

a control unit configured to form, on the image formation medium, a gradation pattern in which a density changing amount is changed according to the gradation step on the basis of the information acquired by the fluctuation-information acquiring unit; and a color sensor that reads the gradation pattern formed on the image formation medium.

2. An image forming apparatus according to claim 1, wherein the image formation medium is a sheet onto which a toner developer serving as a coloring agent is transferred, the image forming apparatus further comprising a color sensor that is arranged on a downstream side of a fixing device that fixes an image of the toner transferred onto the sheet and reads the gradation pattern formed on the sheet.

3. An image forming apparatus according to claim 1, wherein the gradation pattern in which the density changing amount is changed according to the gradation step is set such that the density changing amount is larger in a region in which gradation reproducibility is deteriorated more.

4. An image forming apparatus according to claim 1, wherein the gradation pattern has a first gradation pattern in which equal density changing amounts are set for all gradation steps, a second gradation pattern in which a density changing amount for gradation steps in a low density region and a high density region is set to be greater than a density changing amount for a gradation step in an intermediate region, and a third gradation pattern in which a density changing amount for gradation steps in a low density region and a high density region is set to be greater than the changing amount set in the second gradation pattern.

5. An image forming apparatus according to claim 1, wherein the predetermined characteristic is a charging characteristic of a toner developer serving as a coloring agent.

6. An image forming apparatus according to claim 1, wherein the fluctuation-information acquiring unit acquires at least one of a counter value, temperature, and humidity as the information on a degree of fluctuation in a predetermined characteristic.

7. An image forming apparatus according to claim 1, wherein the gradation pattern includes at least one of a gradation pattern formed by a color obtained by mixing colors of toners of plural colors and a gradation pattern formed by a single color.

8. An image forming apparatus according to claim 1, further comprising:

an image reading unit configured to read the gradation pattern formed on the sheet by the control unit; and a correction-curve calculating unit configured to calculate a correction curve for image adjustment according to a least square method on the basis of an image read by the image reading unit.

9. An image forming apparatus according to claim 1, wherein the predetermined quality adjustment processing is gamma correction processing.

10. An image forming apparatus that forms, on an image formation medium, a gradation pattern formed by a color obtained by mixing colors of coloring agents of plural colors, formed as an image of density changing according to a gradation step, reads a gradation pattern image formed on the image formation medium with a color sensor, and performs predetermined image adjustment processing on the basis of information read, the image forming apparatus comprising:

fluctuation-information acquiring means for acquiring information on a degree of fluctuation in a predetermined characteristic affecting an image quality of an output image;

control means for forming, on the image formation medium, a gradation pattern in which a density changing amount is changed according to the gradation step on the basis of the information acquired by the fluctuation-information acquiring means; and color sensing means that reads the gradation pattern formed on the image formation medium.

11. An image forming apparatus according to claim 10, wherein the gradation pattern in which the density changing amount is changed according to the gradation step is set such that the density changing amount is larger in a region in which gradation reproducibility is deteriorated more.

12. An image forming apparatus according to claim 10, wherein the gradation pattern has a first gradation pattern in which equal density changing amounts are set for all gradation steps, a second gradation pattern in which a density changing amount for gradation steps in a low density region and a high density region is set to be greater than a density changing amount for a gradation step in an intermediate region, and a third gradation pattern in which a density changing amount for gradation steps in a low density region and a high density region is set to be greater than the changing amount set in the second gradation pattern.

13. An image forming apparatus according to claim 10, wherein the predetermined characteristic is a charging characteristic of a toner developer serving as a coloring agent.

14. An image forming apparatus according to claim 10, wherein the fluctuation-information acquiring means acquires at least one of a counter value, temperature, and humidity as the information on a degree of fluctuation in a predetermined characteristic.

15. An image forming apparatus according to claim 10 wherein the gradation pattern includes at least one of a gradation pattern formed by a color obtained by mixing colors of toners of plural colors and a gradation pattern formed by a single color.

16. An image forming apparatus according to claim 10, further comprising:

image reading means for reading the gradation pattern formed on the sheet by the control means; and correction-curve calculating means for calculating a correction curve for image adjustment according to a least square method on the basis of an image read by the image reading means.

17. An image adjusting method in an image forming apparatus that forms, on an image formation medium, a gradation pattern formed by a color obtained by mixing colors of coloring agents of plural colors, formed as an image of density changing according to a gradation step, reads a gradation pattern image formed on the image formation medium with a color sensor, and performs predetermined image adjustment processing on the basis of information read, the image adjusting method comprising the steps of:

acquiring information on a degree of fluctuation in a predetermined characteristic affecting an image quality of an output image;

forming, on the image formation medium, a gradation pattern in which a density changing amount is changed according to the gradation step on the basis of the information acquired in the step of acquiring information of fluctuation; and reading the gradation pattern formed on the image formation medium by a color sensor.

18. An image adjusting method according to claim 17, wherein the gradation pattern in which the density changing amount is changed according to the gradation step is set such that the density changing amount is larger in a region in which gradation reproducibility is deteriorated more.

19. An image adjusting method according to claim 17, wherein the gradation pattern has a first gradation pattern in which equal density changing amounts are set for all gradation steps, a second gradation pattern in which a density changing amount for gradation steps in a low density region and a high density region is set to be greater than a density changing amount for a gradation step in an intermediate region, and a third gradation pattern in which a density changing amount for gradation steps in a low density region and a high density region is set to be greater than the changing amount set in the second gradation pattern.

* * * * *